United States Patent [19]

Fink, Jr.

[11] Patent Number: 5,063,868

[45] Date of Patent: Nov. 12, 1991

[54] BOAT HULL FOR V-BOTTOM POWERBOATS

[76] Inventor: James A. Fink, Jr., Rte. 5, Box 491, Hartsville, S.C. 29550

[21] Appl. No.: 549,339

[22] Filed: Jul. 6, 1990

[51] Int. Cl.[5] ..... B63B 1/18

[52] U.S. Cl. ..... 114/56

[58] Field of Search ..... 114/56, 57, 271, 291; D12/300, 314

[56] References Cited

U.S. PATENT DOCUMENTS

| | | | |
|---|---|---|---|
| 1,935,622 | 11/1933 | Eddy | 114/66.5 |
| 3,113,543 | 12/1963 | Brownback | 114/66.5 |
| 3,117,544 | 1/1964 | Schoell | 114/56 |
| 3,330,239 | 7/1967 | Dornak | 114/56 |
| 3,776,168 | 12/1973 | Weeks | 114/56 |
| 4,022,143 | 5/1977 | Krenzler | 114/56 |
| 4,027,613 | 6/1977 | Wollard | 114/291 |
| 4,128,072 | 12/1978 | Wood, Jr. | 114/291 |
| 4,193,366 | 3/1980 | Salminen | 114/39 |
| 4,193,370 | 3/1980 | Schoell | 114/56 |
| 4,619,215 | 10/1986 | Wood et al. | 114/56 |
| 4,726,310 | 2/1988 | Ard et al. | 114/56 |
| 4,813,365 | 3/1989 | Lindstrom et al. | 114/56 |
| 4,903,626 | 2/1990 | Haines | 114/56 |

*Primary Examiner*—Jesus D. Sotelo

*Assistant Examiner*—Stephen P. Avila

*Attorney, Agent, or Firm*—Bell, Seltzer, Park & Gibson

[57] ABSTRACT

A powerboat hull construction with greatly enhanced performance characteristics is provided. The boat hull construction includes a bow having a forward nose, a stern which includes a transom, and a bottom which extends forwardly from the transom to the nose and which includes an outside surface which is intended to contact the water. The outside surface of the bottom is generally V-shaped in transverse cross-section to define a centerline keel which further divides the outside surface into opposed symmetrical sides. The two sides each include a plurality of running surfaces which extend from the transom to the bow line and with the running surfaces defining generally straight, substantially parallel lines which are laterally offset from each other when viewed in transverse cross-section and a lifting surface which extends laterally between each adjacent pair of running surfaces with each lifting surface extending substantially the full length of the bottom from the transom to the bow and defining a generally straight line when viewed in transverse cross-section. The boat hull of the invention provides improved turning characteristics and also reduces incidents of prop ventilation occasioned by the prior art strake surfaces.

13 Claims, 6 Drawing Sheets

BOAT HULL FOR V-BOTTOM POWERBOATS

BACKGROUND OF THE INVENTION

This invention relates to a one-piece powerboat hull construction which has greatly enhanced performance characteristics.

Over the years the design of watercraft has evolved dramatically. Many design changes have been enabled by the advent of new construction materials or manufacturing techniques that have transformed the cumbersome wooden powerboats of old into the sleek and hydrodynamic powerboats of today. Powerboats today have hulls that are typically of one-piece molded construction and which have sleek dynamic style lines.

One of the most popular hull designs in use today is the V-bottom hull. The V-bottom hull is generally preferred by pleasure boaters for its smooth ride in rougher, choppy water and also for its excellent handling characteristics particularly when executing turns.

The same V-bottom construction which provides generally preferred performance characteristics, however, also possesses drawbacks in comparison to a fully or generally planar bottom. Specifically, the V-shape of the hull which provides excellent hydrodynamic performance as it slices through the water also requires the addition of modified outside surfaces to provide adequate lift when the boat is operated at higher running speeds. For this reason, the bottom surface of the V-type hull also typically includes a plurality of longitudinally extending lifting strakes which include one surface disposed generally parallel to the surface of the water and a second surface disposed at about right angles to the first surface. This is to be distinguished from the generally almost oblique orientation of an unmodified V-bottom hull when viewed in cross-section.

The use of lifting strakes on boat hulls of the V-bottom type is essential to the stability of this type of craft in order to achieve higher operating speeds. Typical configurations for lifting strakes are shown in prior U.S. Pat. No. 3,117,544 to Schoell and in U.S. Pat. No. 4,027,613 to Wollard. As can be seen by reference to the transverse sectional views in these patents, the running surfaces in these V-bottom hull constructions all lie in the same plane of orientation normal to the keel of the boat. Accordingly, the lifting strake surfaces may be considered to be "add-ons" to the almost perfect V-shaped outline defined by the running surfaces. As alluded to above, the lifting strakes are typically formed of two generally perpendicular surfaces which define an included angle of almost 90 degrees between the adjacent pairs of running surfaces.

The relative positioning of the running surfaces which define the general outline of the vee, and the configuration of the lifting strakes in conventional V-type hull bottom designs, gives rise to several serious shortcomings. For example, the relative positioning of the running surfaces and the overall configuration of the strakes means that a plurality of longitudinal protrusions will be defined along the bottom surface of the hull and with portions thereof which will lie essentially perpendicular to the surface of the water to provide the needed lift. Accordingly, as the general orientation of the hull to the water's surface is altered by a high speed turn, for example, hydrodynamic forces will be exerted on the outside surface of the bottom against the strake which will in turn act like a rudder. These forces will tend to force the chine or spray wall disposed on the outside of the turn downwardly against the surface. This presents an extremely dangerous situation during high speed turns particularly for novice boaters as described, for example, in U.S. Pat. No. 4,726,310 to Ard, et al. Experienced boaters are customarily forced to throttle down prior to executing virtually any turn because of these forces.

A related problem presented by the use of conventional strakes resides in the relative performance characteristics of the engine itself. Specifically, conventional strake designs tend to generate air bubbles which can become entrained against the propeller and cause prop ventilation. Prop ventilation robs the powerboat of needed horsepower and requires the operator to throttle down until the entrained air dissipates or is otherwise displaced from the surface of the blades. This is obviously frustrating especially for experienced operators who, despite their skill, routinely experience prop ventilation while executing turns and especially in virtually all high speed turns.

One material offshoot of the prop ventilation problem resides in the relative positioning of the cavitation plate and of the prop on stern drive powerboats. Specifically, and in order to minimize incidents of prop ventilation, the cavitation plate and prop must be positioned at a relatively lower elevation to the keel than is desired for optimum efficiency based on any given horsepower. Stated otherwise, the lower positioning of the propeller increases the effective drag on the boat. The significant advantages which can flow from the ability to position the prop even a single inch closer to the keel are recognized in the prior art as discussed, for example, in the background of U.S. Pat. No. 4,619,215 to Wood, et al. As described there, the relative drag caused by the prop and housing increases exponentially with increasing propulsion unit submergence. Thus, it is desired to position the cavitation plate and propeller as close to the transom as possible when, for example, the lower unit of a stern drive motor is fully trimmed.

Although the prior art has recognized the significant drawbacks associated with conventional boat hull designs, no satisfactory solution to the related problems of stability in turns and performance have yet been devised. For example, the design shown in Wood, et al. U.S. Pat. No. 4,619,215 incorporates a series of adjacent steps wherein the planing surfaces of the strakes disposed between adjacent running surfaces include the problematic generally perpendicular surfaces and with the corresponding drawbacks described hereinabove. And, in recent U.S. Pat. No. 4,903,626 to Haines, it is proposed to incorporate a transverse recess and step in the hull bottom in order to permit the propeller of the outboard engine used there to be elevated, but at the obvious expense of stability. Furthermore, while the structure of Haines does appear to incorporate an improved strake configuration in comparison to the prior art, the interior strake surfaces shown there are intentionally bifurcated well short of the stern which will in fact lead to the generation of additional turbulence and corresponding reductions in performance resulting from increased incidents of prop ventilation.

SUMMARY OF THE INVENTION

In order to overcome the shortcomings of the prior art, the boat hull construction of the present invention is designed so as to maximize the handling characteristics of the boat while at the same time minimizing the disruptive effects caused by the generation of a vortex as by conventional strakes having one surface disposed generally horizontally to the surface of the water surface and a second surface disposed at about right angles to the first surface. In order to accomplish these objects, a one-piece powerboat hull is provided which includes a forward nose, a stern including a transom, and a bottom having an outside surface which extends forwardly from the transom to the nose. The outside surface of the bottom has a generally V-shaped outline in transverse cross-section and incorporates a centerline keel extending from the transom which merges into a bow line aft of the nose and which divides the outside surface of the bottom into two opposed sides which are symmetrically disposed on either side of the keel and the bow line.

In accordance with the present invention, each side of the boat hull bottom includes a plurality of running surfaces which extend from the transom to the bow line and which, when viewed in transverse cross-section, define generally straight, substantially parallel lines which are laterally offset from one another. In addition, lifting surfaces are provided which extend laterally between each adjacent pair of the running surfaces on either side of the keel. Each lifting surface defines a generally straight line between adjacent pairs of running surfaces when viewed in transverse cross-section, and with the lifting surfaces also extending substantially the full length of the bottom from the bow of the boat hull to the transom, or just adjacent the transom, in order to minimize the generation of any vortex as discussed herein.

As a result of the foregoing construction, right angles are avoided in the surfaces providing the lifting action between adjacent running surfaces during operation of the powerboat. By these expedients, a boat hull design is provided which retains an overall V-shaped outline, but which does not possess the conventional shortcomings, even though the hull is designed for use in high performance craft with maximum horsepower of approximately 200 horsepower or even greater. The resulting benefits include excellent maneuverability even in the sharpest turns but while surprisingly minimizing the generation of air bubbles even at the relatively higher speeds at which these turns are executed. Surprisingly, the design accomplishes such efficiencies that it has also been found possible to raise the cavitation plate and the propeller at least 1–2 inches closer to the keel in order to achieve even greater running speeds in use.

BRIEF DESCRIPTION OF THE DRAWINGS

Additional features of the invention will be described hereinbelow in detail when taken in connection with the accompanying drawings in which.

DESCRIPTION OF THE PREFERRED EMBODIMENTS

Figure 1:
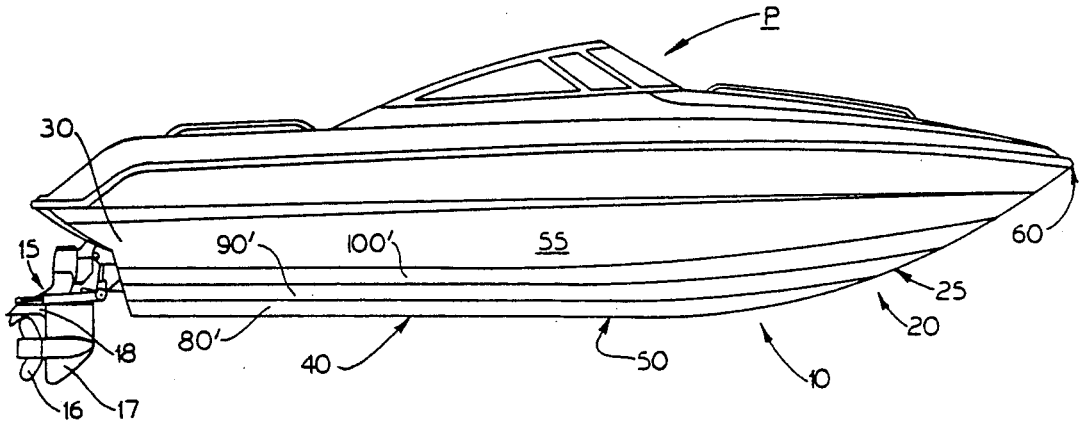
FIG. 1 is a side elevation view of a powerboat including the one-piece hull of the present invention in accordance with one preferred embodiment of the present invention.

An illustrative powerboat P is shown in FIG. 1 as incorporating the hull structure 10 of the present invention which is preferably of molded one-piece construction. As shown there, the hull 10 includes a bow 20 which includes a nose 60, a stern 30, and with the stern 30 incorporating a transom 35. The powerboat also includes an engine (not shown), the details of which are not material to this invention and which is of otherwise conventional type. As particularly shown, the representative embodiment of the powerboat P is equipped with a stern drive engine which has a lower member 15 and which includes the propeller 16, a skeg 17, and a cavitation plate 18. The powerboat hull 10 also includes a bottom surface 40 which extends from the transom 35 at the stern 30 to the nose 60, substantial portions of which contact the surface of the water when the powerboat is in use.

When viewed in transverse section, the powerboat hull 10 will be of a generally V-shaped outline (e.g., FIG. 3) with the bottom of the V serving to define the centerline keel 50 of the hull 10. In customary fashion, the keel 50 serves to divide the hull into two symmetrical halves each of which is a mirror image of the other. The keel extends from the transom 35 and then merges into a bow line 25 aft of the nose 60.

Figure 2:
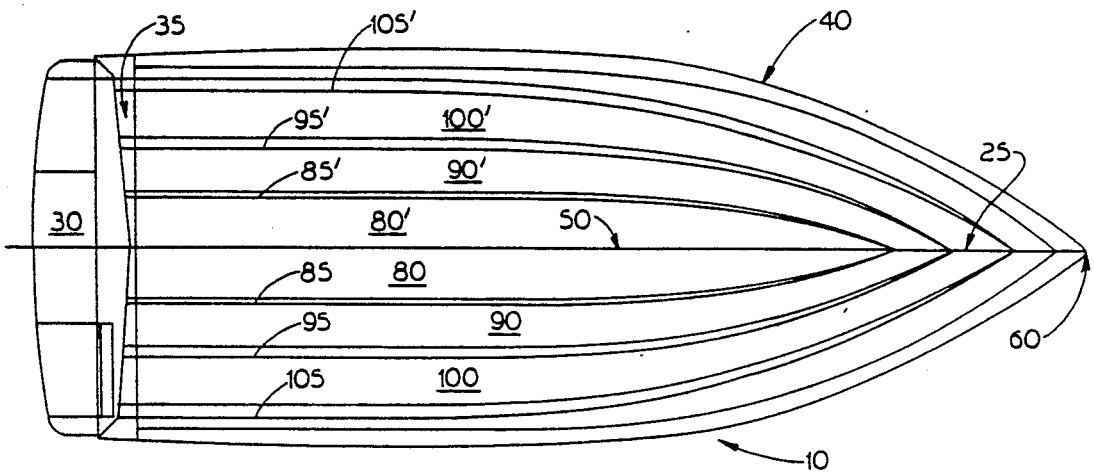
FIG. 2 is a bottom plan view of the powerboat depicted in FIG. 1 and showing the general pattern of the running surfaces and lifting surfaces extending longitudinally along the bottom surface of the hull, also in accordance with the preferred embodiment of the present invention.

In accordance with the present invention, the bottom surface 40 of the hull 10 is divided into a plurality of running surfaces 80, 90, 100, and 80', 90', 100' (FIG. 2) which, when viewed in transverse cross-section (FIG. 4) define generally straight, substantially parallel lines which are laterally offset from each other. Stated otherwise, the bottom surface 40 of the hull 10 of the present invention, in contrast to conventional hull constructions (FIG. 4) may be said to define three distinct hull forms which are nested inside of each other. For ease of reference, a single reference character will be used to refer to the running surfaces and lifting surfaces respectively, even though there are two sets of each (i.e., 80, 90, 100 and 80', 90', 100') which are identical to each other running along either side of the centerline defined by the keel 50 and the bow line 25. Accordingly, descriptions pertaining to these elements will apply to either set although the specific references are omitted to avoid undue prolix.

Figure 3:
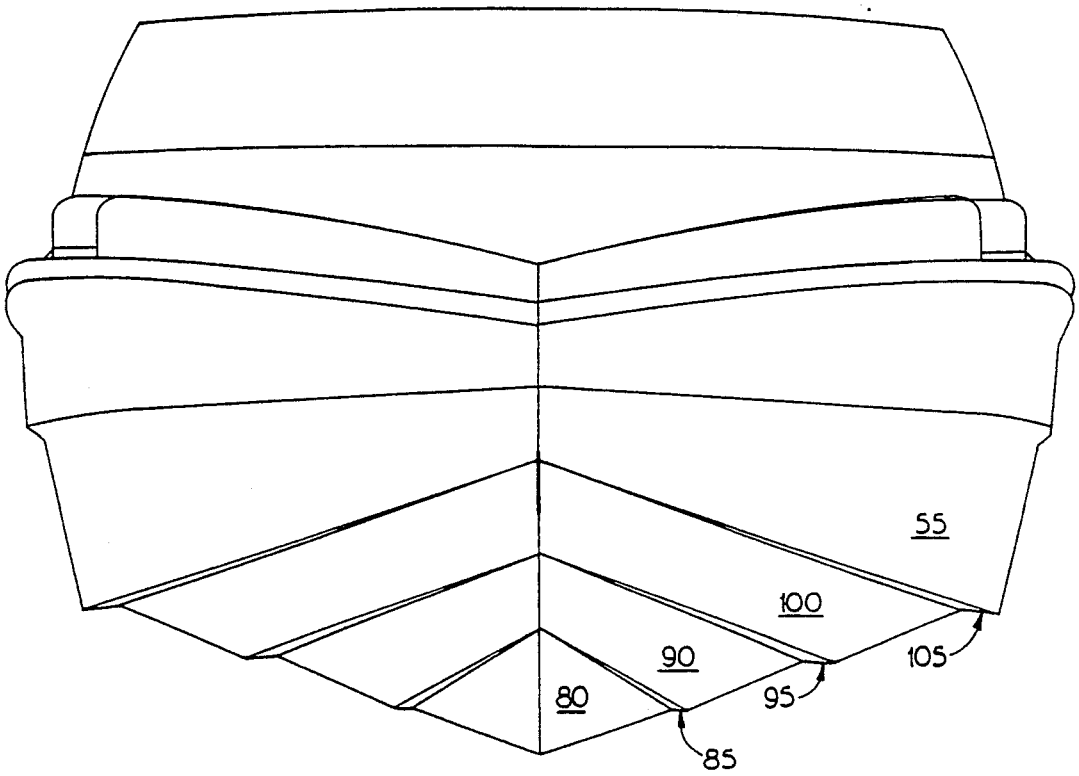
FIG. 3 is a front perspective view of the powerboat hull of FIG. 1.
Figure 5:
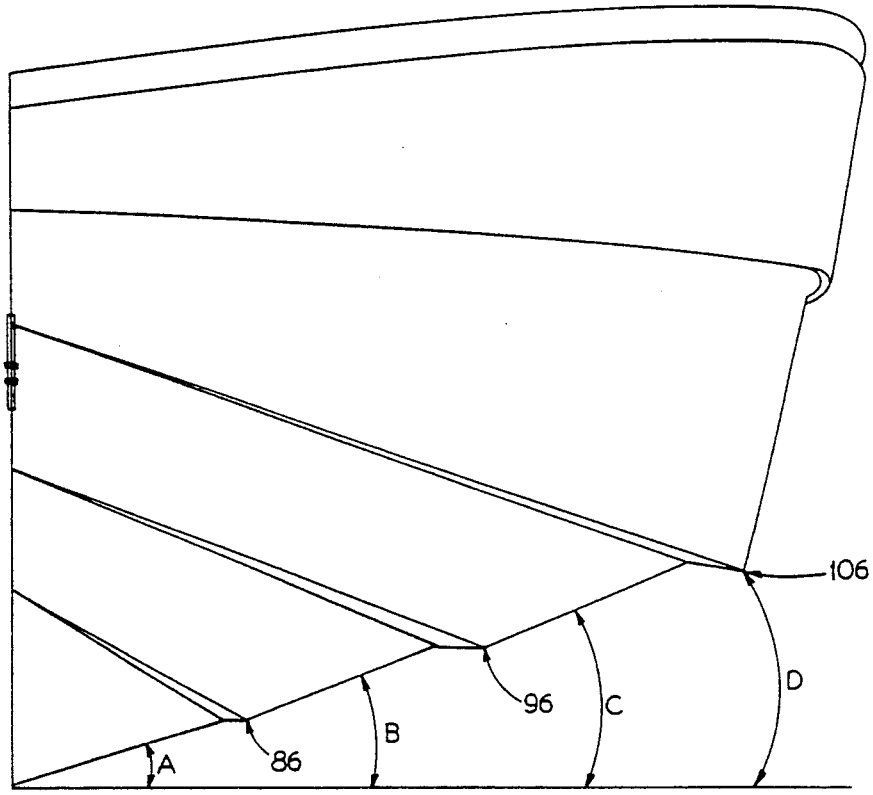
FIG. 5 is an enlarged front view of the hull as shown in FIG. 3 and depicting preferred relative angular positioning for the running surfaces and the lifting surfaces as they appear at about the bow line.
Figure 6:
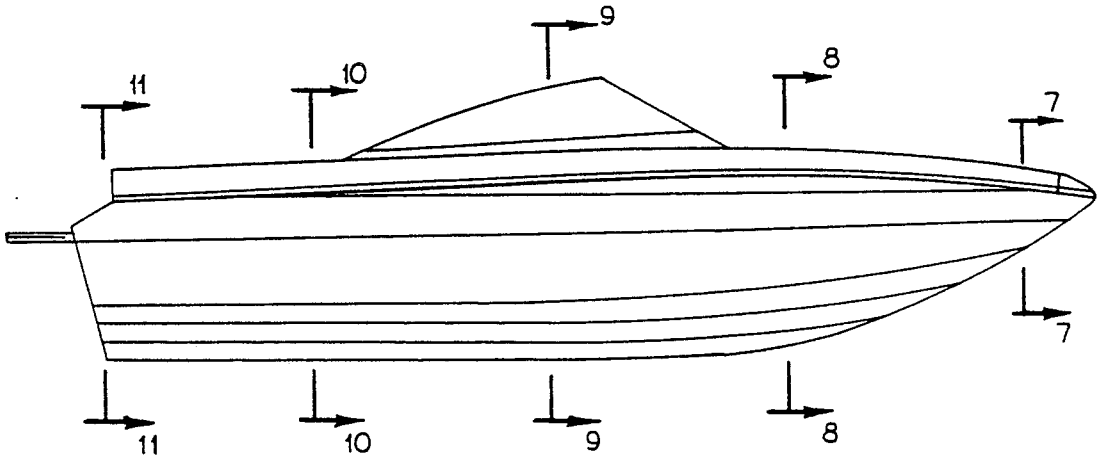
FIG. 6 is a further side perspective view of the hull of FIG. 1 for reference purposes in respect of considering FIGS. 7–11.
Figure 9:
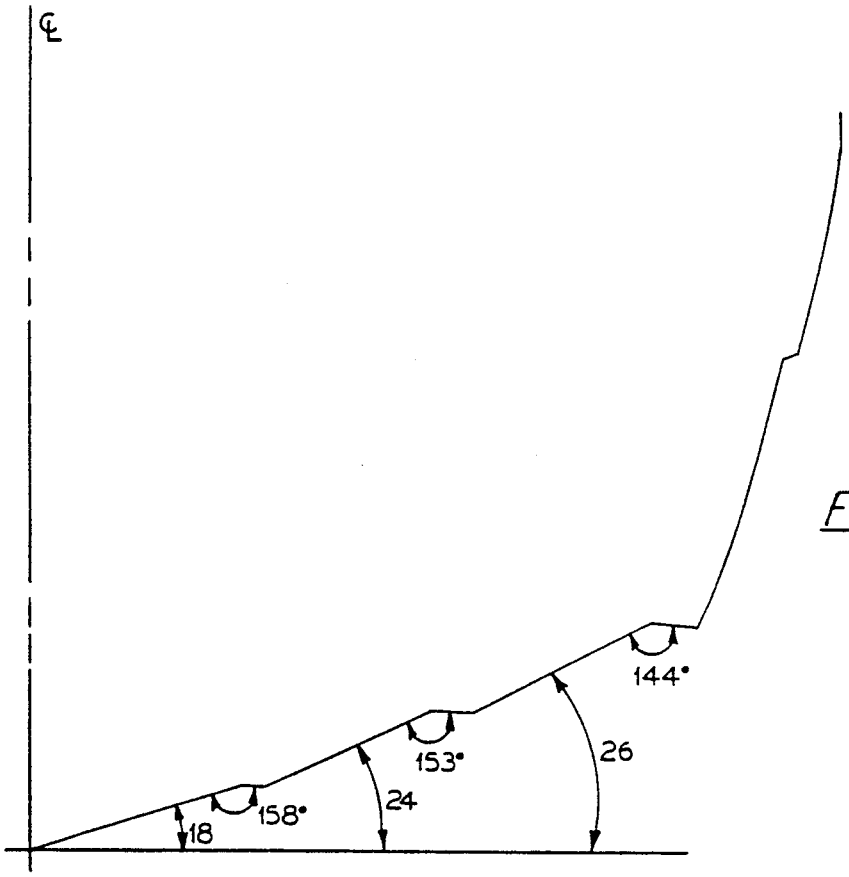
FIG. 9 is a partial transverse section view through the centerline of the hull taken substantially along the line 9—9 in FIG. 6.
Figure 10:
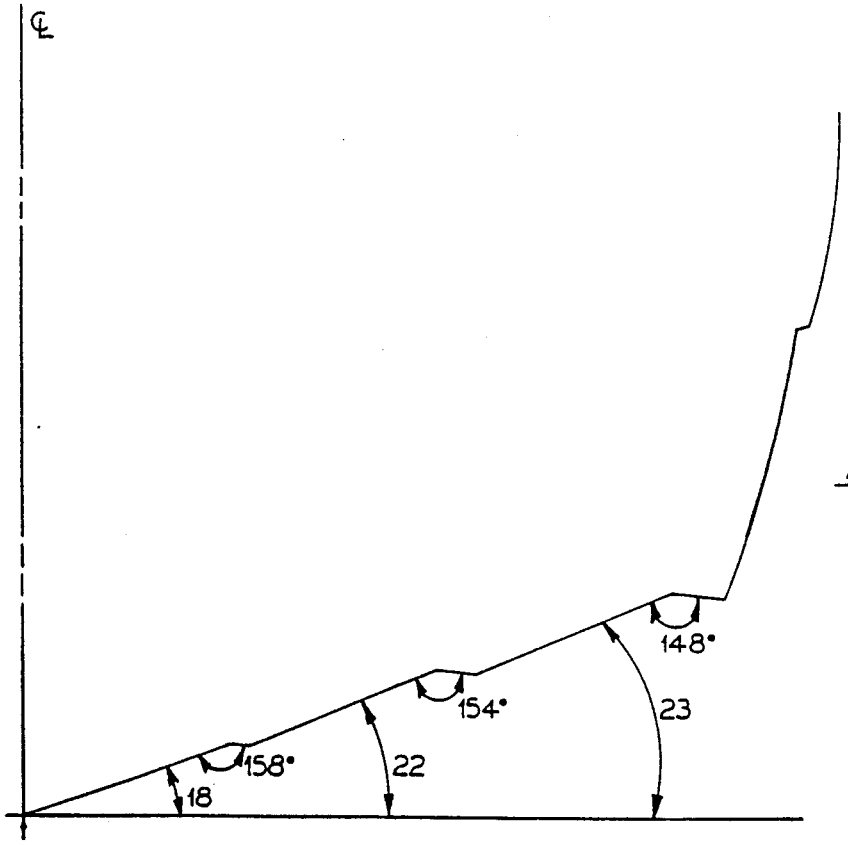
FIG. 10 is a partial transverse section view through the centerline of the hull taken substantially along the line 10—10 in FIG. 6.

As best seen in FIG. 3, the three forms defining the running surfaces 80, 90, 100 are preferably nested so that the angles A, B, and C defined by these running surfaces to the horizontal, or the deadrise, increases slightly in progression from the keel 50 to the chine or spray rail 105 which merges into the sidewall 55. The overall angle D defined by an imaginary line extending from the outer surface 106 of the chine 105 to the keel 50 will preferably be less than the angles A, B, and C as defined by each of the respective running surfaces 80, 90, and 100. For example, the angles A, B, C (FIG. 5) as measured, for example, at the area indicated at section line 9 (FIGS. 6 and 9) are approximately 18°, 24°, and 26° respectively while the angle D measures approximately 17.5°.

Figure 4:
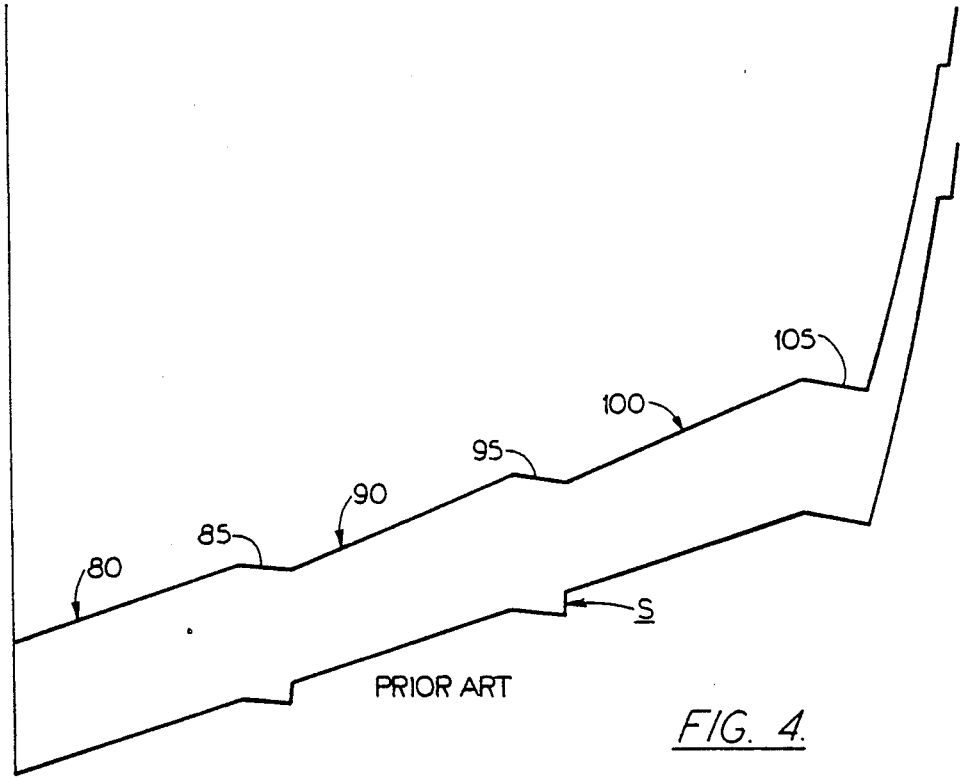
FIG. 4 is a partial representative section view of a portion of the hull near the transom and additionally depicting, by way of contrast, the transverse section view of a conventional boat hull including the generally horizontal and perpendicular lifting strake surfaces of the prior art.
Figure 7:
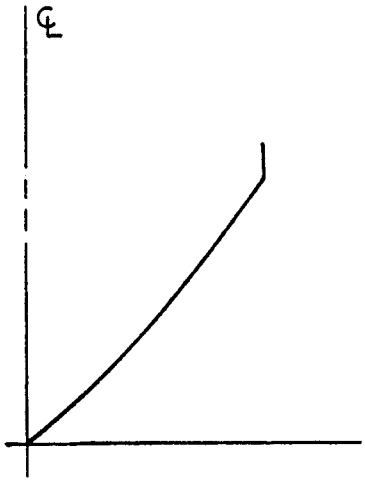
FIG. 7 is a partial transverse section view through the centerline of the hull taken substantially along the line 7—7 in FIG. 6.
Figure 8:
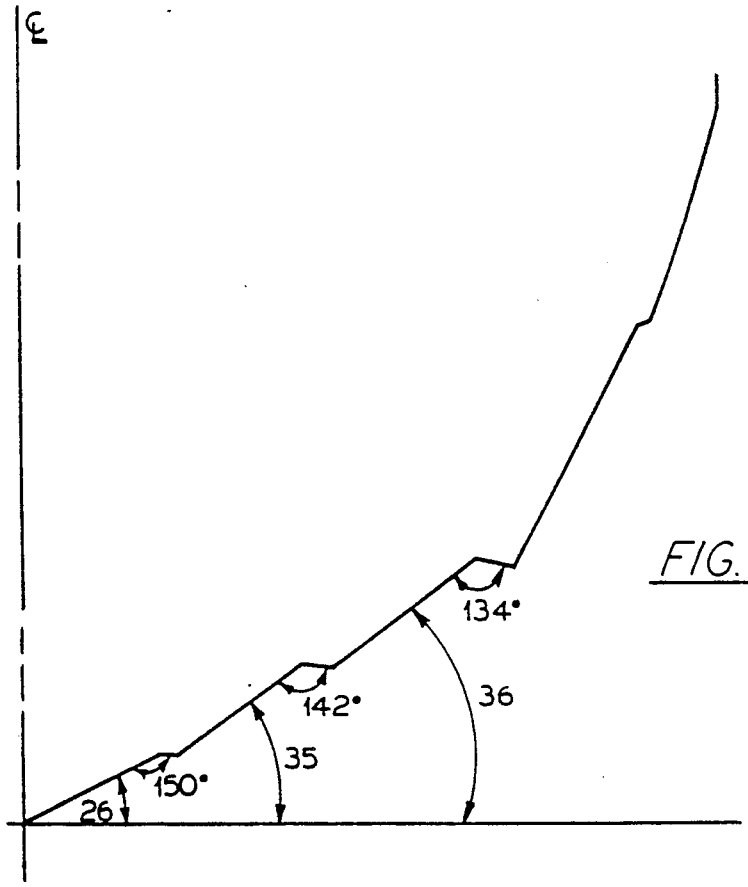
FIG. 8 is a partial transverse section view through the centerline of the hull taken substantially along the line 8—8 in FIG. 6.

In addition to the running surfaces 80, 90, 100, the bottom surface 40 of the hull 10 also includes lifting surfaces, shown at 85 and 95, which are disposed between adjacent pairs of running surfaces. For example, lifting surface 85 will be disposed between adjacent running surfaces 80 and 90, while lifting surface 95 will be disposed between adjacent running surfaces 90 and 100. In accordance with the present invention, the lifting surfaces 85 and 95 define a generally straight line when viewed in transverse cross-section and interconnect the adjacent running surfaces. Thus, there are no right angles as found in prior art strake surfaces (FIG. 4). Furthermore, the lifting surfaces preferably extend substantially the full length of the bottom from the transom 35 or just adjacent the transom 35, all the way to the area of the bow adjacent the bow line 25 where they merge into the sidewall of the bow (FIG. 7) at distinct corresponding points aft of the nose 60 of the hull 10.

The precise angles established by the running surfaces 80, 90, 100 to the horizontal plane may vary depending upon the intended use of the craft in accordance with customary design practices. Specifically, these angles are customarily modified depending upon whether a particular craft is designed for generally high speed pleasure boating or for use in other applications such as fishing. This would also include considerations of whether a cabin is provided and the relative positioning of the cabin along the hull. Similarly, the relative width of the running surfaces and of the lifting surfaces may also be varied depending upon the overall design characteristics desired for the craft including the intended load of the boat and, again, depending upon the relative positioning of the cabin fore or aft. In general, heavier boats will require that wider lifting surfaces be deployed while lighter weight designs enable the use of narrower and perhaps more numerous lifting surfaces. In accordance with the present invention, however, the criterion customarily used in boat hull design may be applied with some experimentation being expected to optimize all of the performance characteristics of the hull design. In general, however, the number of total lifting surfaces may vary in the range from one to five on each side of the centerline defined by the keel 50, and typically, as reflected in the drawing, will number approximately two lifting surfaces on each side of the centerline between the keel 50 and the chine 105.

The overall angle defined by the V typically will range from approximately 16°-23°, with a majority of pleasure craft falling in the range of approximately 17°-19° as measured from the bottom surface of the hull at the transom. As shown in the drawings, the preferred embodiment incorporates an angle of approximately 17.5° to the horizontal.

In accordance with the present invention, the angles defined between the adjacent running surfaces and the lifting surfaces may be varied. In general, it is considered desirable to maintain the relative angle of the lifting surfaces to horizontal in the range from approximately 0°-5° either positive or negative and preferably at a negative angle. More specifically, it is particularly preferred to maintain the angle at a minimum of approximately 2° negative to horizontal in order to deflect the water as the boat planes in a direction generally away from the occupants. It has been found that the nested construction of the running surfaces and lifting surfaces has improved the performance of the hull bottom in maintaining a dryer boat in contrast to the prior art construction as seen by comparison in FIG. 4. As will be evident, water droplets which are deflected from the outside surfaces of the strakes defining included right angles as in the prior art may be deflected on a general trajectory which would place them outside the outer surface of the chine in contrast to the design of the present invention wherein the outer surface of the chine should deflect a substantial portion of water droplets downwardly. In this vein, it is particularly preferred to orient the chine 105 in the same manner, and consistent with the overall angular orientation of the running surfaces and lifting surfaces for this purpose.

In designing the overall configuration of the hull 10, and in establishing the specific angles for the nested, offset construction of the running surfaces 80, 90, 100 in accordance with the present invention, it is particularly desirable to orient each of the respective surfaces so that the exterior points of intersection between a lifting surface and the adjacent running surface are arranged so that all of the exterior points of intersection, for example 86 and 96 (FIG. 5), are disposed substantially along the line extending from the outer surface 106 of the chine 105 to the center point of the keel (FIG. 4). In addition, and as noted in part above, each of the angles defined between the running surfaces 80, 90, 100 and the horizontal preferably are of increasing magnitude from the keel to the chine and will also generally increase from the transom 35 in the direction of the bow line 25 as shown by representative examples in FIGS. 7-11.

Figure 11:
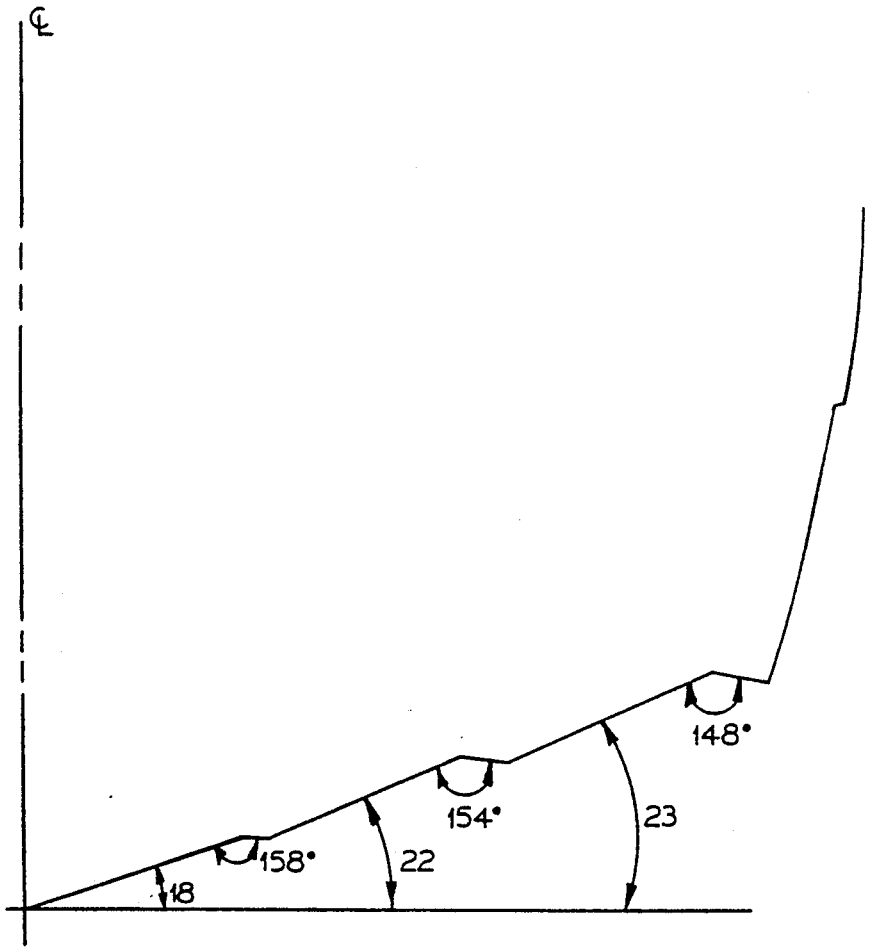
FIG. 11 is a partial transverse section view through the centerline of the hull taken substantially along the line 11—11 in FIG. 6.

Also in designing the layout of the running surfaces and the lifting surfaces, the total running surface of the bottom of the hull may generally and preferably be divided into three substantially equidistant segments so that, for example, the distance between the keel and the first lifting surface (FIG. 11) or the width of running surface 80, is approximately 12 inches, running surface 90 is approximately 11.2 inches in width and running surface 100 is approximately 12 inches as shown for the particular preferred embodiment. The width of the lifting surfaces may likewise be varied and, as illustrated in FIG. 11, for example, in the area of the transom, the lifting surface lying closest to the keel 85 is approximately 1.3 inches in width, while lifting surface 95 has a width of approximately 2.7 inches. In the preferred embodiment as illustrated, the width of the chine 105 is approximately 3 inches at the transom for a boat dimensioned to have an overall length of 21 feet.

The included angles defined by a discrete running surface and its adjacent lifting surface along the outside surface of the bottom extending outwardly from the keel 50 may also be varied in accordance with the present invention. As indicated by FIGS. 7–11, these angles will range from about 130°–160° as shown for the preferred embodiment and are all about 150°. Representative included angles as defined by these exterior surfaces are all shown in FIGS. 7–11 at representative sections along the longitudinal length of the hull. For example, the angles at line 9 (FIG. 6) as defined by the running surface 80 and the lifting surface 85 is approximately 158° while the included angle defined by the surface of the lifting surface 90 and the next adjacent running surface 100 is approximately 153°. These angles may be varied over a relatively wide range, but consistent with the overall considerations of maintaining the overall V configuration of the hull and preferably by retaining the preferred negative angular orientation for the lifting surfaces to the horizontal.

The lifting surfaces extend along the bottom surface of the hull along substantially the full length thereof from the bow line 25 to the transom 35 as depicted generally in the various sections of FIGS. 7–11. The lifting surfaces also merge into the bow at or just adjacent the bow line 25 at the bow 20 as also shown diagrammatically in these views so that lifting surface 85, for example, has almost merged into the bow at about transverse line 8 (FIG. 6) while all of the lifting surfaces have merged into the bow line 25 in advance of the nose 60 section thereof in FIG. 7.

The resulting hull configuration provides greatly improved results over the prior art. A particularly significant advantage resides in the elimination of the right angles characteristic of the prevailing prior art hull constructions as depicted in transverse section in FIG. 4. As noted in the Background, the right angle defined by the compound lines of the strake surface in the conventional construction create a rudder effect in high speed turns which has been recognized as a serious problem in the prior art. In the substantially more hydrodynamic construction of the present invention, no right angles are presented to the surface of the water and the overall contoured design leads to excellent running characteristics at high speed. Moreover, the elimination of the right angles greatly minimizes the generation of air bubbles during high speed planing. While the phenomenon leading to the creation of these bubbles is not fully understood, it is believed that the vortex is generated by virtue of the area of generally lower pressure which will lie in the areas adjacent the right angles defined by the strake surfaces of the prior art.

The vortex formed along the longitudinal extent of the bottom surface of the hull of the prior art will extend beyond the rear of the boat with the result that upon reorienting the hull in a turn, for example, the air generated in the vortex can become entrained against the propeller 16 and cause ventilation. In accordance with the present invention, and especially in the preferred design of the lifting surfaces extending to or adjacent the transom, the formation of the vortex is greatly minimized, in contrast to the prior art. This leads to the beneficial results that the operator need not throttle down through the turns to attempt to remove the air bubbles from the propeller.

It has also been discovered that the use of the present invention for a bottom hull design enables the raising of the cavitation plate and propeller approximately 1–3 inches above normal which is also art recognized as providing a significant advantage in increasing the maximum running speed of the powerboat at the same relative horsepower. For example, a boat having a top speed of approximately 50 mph with the conventional hull construction and strake surfaces has a top speed of at least several miles per hour higher under the same conditions. Moreover, the added benefits described above in terms of improved turning characteristics and reduced cavitation are retained even at these higher speeds meaning that the overall efficiency of the craft is greatly enhanced over the prior art.

It should be understood that the foregoing drawings and specification are presented for purposes of describing the preferred embodiment only and that they should not be utilized for the purpose of unduly limiting the scope of the present invention, which scope is defined solely by the appended claims presented hereinbelow.

That which is claimed is:

1. A one-piece powerboat hull comprising a forward nose, a stern which includes a transom, and a bottom which extends forwardly from said transom to said nose and which includes an outside surface which is intended to contact the water, said outside surface of said bottom having a generally V-shaped outline in transverse cross-section so as to define a centerline keel which extends forwardly from said transom and merges into a bow line aft of said nose, and opposite sides, said opposite sides being generally symmetrical about said centerline keel and bow line, and with each side including (a) a plurality of running surfaces extending from said transom to said bow line, and with said running surfaces defining generally straight, substantially parallel lines which are laterally offset from each other when viewed in transverse cross-section, and (b) a plurality of lifting surfaces, including a lifting surface extending laterally between each adjacent pair of running surfaces along substantially the full length of said bottom from said transom to said bow and defining a generally straight line when viewed in transverse cross-section, and with each said lifting surface additionally defining an angle, relative to the horizontal, in the range from about 0° to 5°, either positive or negative.

2. The powerboat hull as defined in claim 1 wherein each of said lifting surfaces has a maximum lateral width at said transom and tapers to a minimum lateral width at said bow line.

3. The powerboat hull as defined in claim 2 wherein, adjacent the transom, each of the intersections between a running surface and a lifting surface defines an included angle of about 150 degrees.

4. The powerboat hull as defined in claim 3 wherein, adjacent the transom, each of said running surfaces is inclined at an angle of about 20 degrees from the horizontal.

5. The powerboat hull as defined in claim 1 wherein the hull is of molded one-piece construction.

6. The powerboat hull as defined in claim 1 wherein the relative angle defined between each said lifting surface and horizontal is about 2° negative.

7. The powerboat hull as defined in claim 1 wherein the outside surface of the bottom of said hull defines three distinct hull forms which are nested inside of each other.

8. The powerboat hull as defined in claim 7 wherein the angle defined between each running surface and horizontal increases outwardly from said keel.

9. A one-piece powerboat hull comprising a forward nose, a stern which includes a transom, and a bottom which extends forwardly from said transom to said nose and which includes an outside surface which is intended to contact the water, said outside surface of said bottom having a generally V-shaped outline in transverse cross-section so as to define a centerline keel which extends forwardly from said transom and merges into a bow line aft of said nose, and opposite sides, said opposite sides being generally symmetrical about said centerline keel and bow line, and with each side including (a) a plurality of running surfaces extending from said transom to said bow line, and with said running surfaces defining generally straight, substantially parallel lines which are laterally offset from each other when viewed in transverse cross-section and which define three distinct hull forms nested inside each other, and (b) a plurality of lifting surfaces, including a lifting surface extending laterally between each adjacent pair of running surfaces along substantially the full length of said bottom from said transom to said bow and defining a generally straight line when viewed in transverse cross-section, and with the included angle defined between each running surface and the next adjacent lifting surface falling in the range from about 130 to 160 degrees.

10. The powerboat hull as defined in claim 9 wherein, adjacent the transom, each of said running surfaces is inclined at an angle of about 20° from the horizontal.

11. The powerboat hull as defined in claim 9 wherein each said lifting surface defines an angle relative to the horizontal, in the range from about 0° to 5°, either positive or negative.

12. The powerboat hull as defined in claim 11 wherein each said lifting surface defines a relative angle from the horizontal of about 2° negative.

13. The powerboat hull as defined in claim 12 wherein the hull is of molded one-piece construction.

* * * * *